United States Patent [19]

Harris

[11] Patent Number: 4,866,798

[45] Date of Patent: Sep. 19, 1989

[54] SUPPORT MEMBER FOR BOX SPRING FRAMES

[75] Inventor: George M. Harris, Homewood, Ill.

[73] Assignee: Harris-Hub Company, Inc., Harvey, Ill.

[21] Appl. No.: 252,756

[22] Filed: Oct. 3, 1988

[51] Int. Cl.[4] ..... A47C 23/05

[52] U.S. Cl. ..... 5/263; 5/264 B; 52/730

[58] Field of Search ..... 5/246, 200.12, 239, 5/263, 269, 265 B, 400; 267/100, 101; 52/223 R, 730, 732, DIG. 6, 716, 815, 821, 822; 411/466, 467, 469

[56] References Cited

U.S. PATENT DOCUMENTS

| | | | |
|---|---|---|---|
| 3,717,886 | 2/1973 | Watts | 52/730 X |
| 3,842,639 | 7/1974 | Mandusky | 5/264 B X |
| 3,877,091 | 4/1975 | Jureit et al. | 5/269 B X |
| 4,299,511 | 11/1981 | Oemers | 411/466 X |
| 4,639,176 | 1/1987 | Smith et al. | 52/DIG. 6 |
| 4,738,071 | 4/1988 | Ezard | 52/DIG. 6 |

*Primary Examiner*—Gary L. Smith
*Assistant Examiner*—Michael F. Trettel
*Attorney, Agent, or Firm*—Dressler, Goldsmith, Shore, Sutker & Milnamow, Ltd.

[57] ABSTRACT

An improved, longitudinally extending, centrally disposed support member for a box spring frame of increased strength and reinforcing support is disclosed. The support member includes an elongate slat that has at least one metal reinforcing member affixed thereto. The metal reinforcing member has a plurality of longitudinally spaced openings therein, each of the openings having penetrating means projecting therefrom and penetrating into the elongate slat to affix the reinforcing members to the slat.

16 Claims, 1 Drawing Sheet

FIG. 1
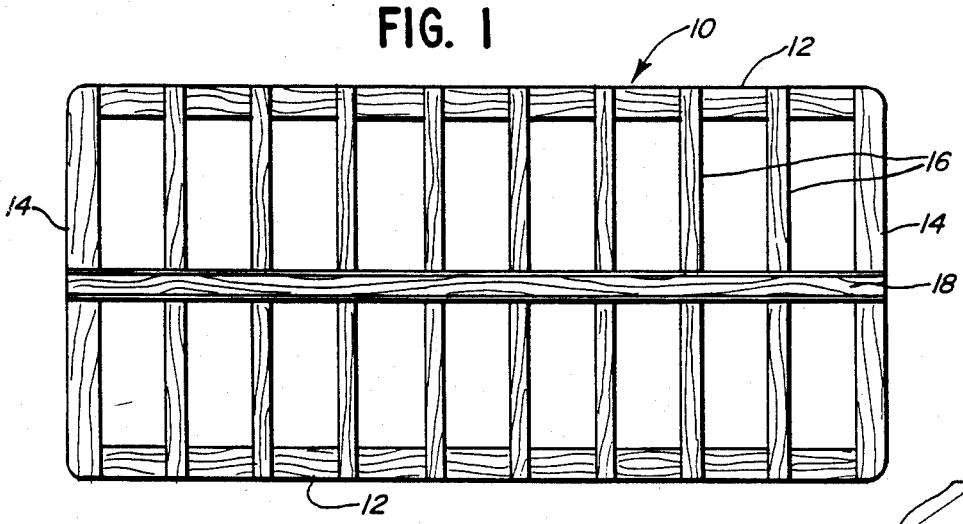
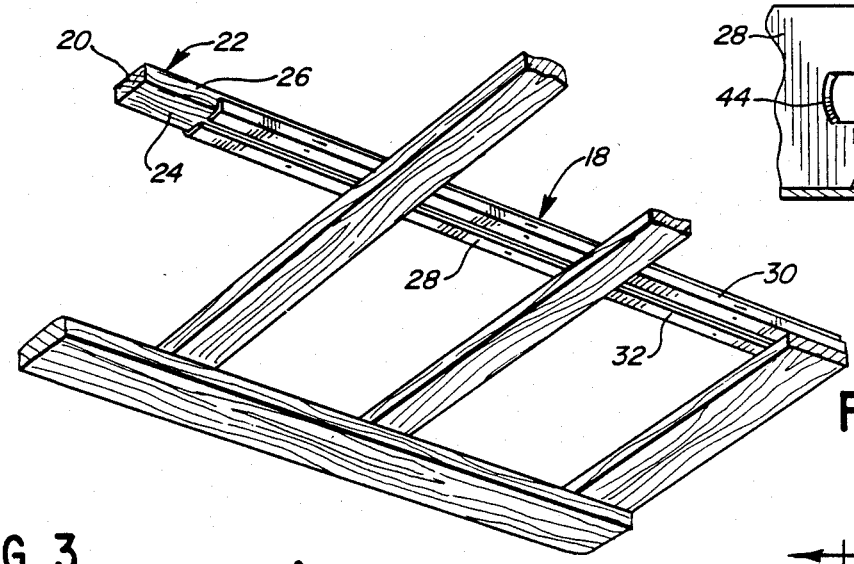
FIG. 2
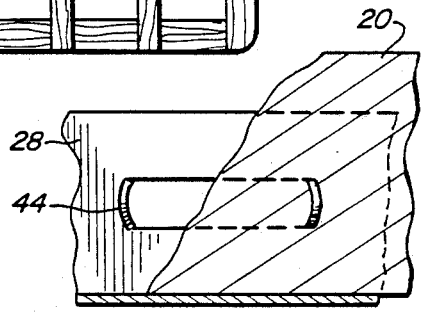
FIG. 6
FIG. 3
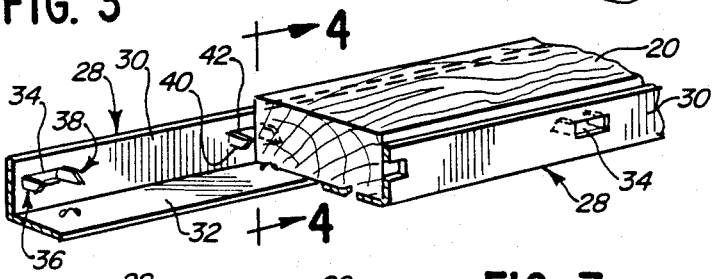
FIG. 4
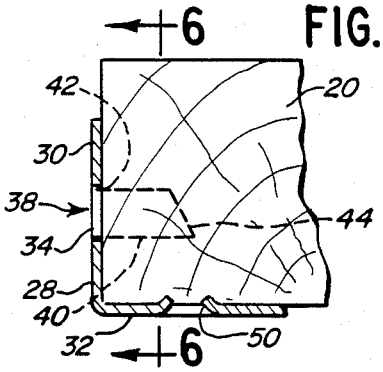
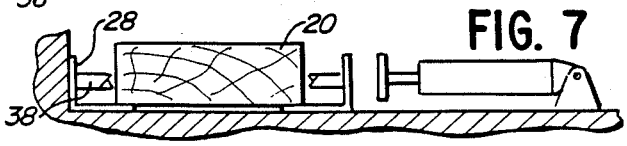
FIG. 7
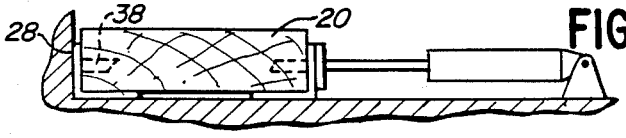
FIG. 8
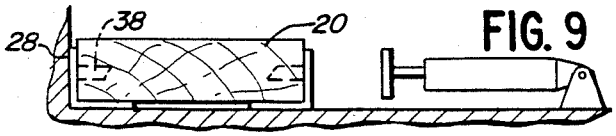
FIG. 9
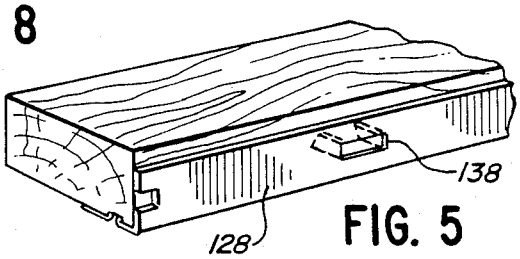
FIG. 5

SUPPORT MEMBER FOR BOX SPRING FRAMES

TECHNICAL FIELD

The present invention relates to a support member for box spring frames. More particularly, this invention relates to an improved longitudinally extending, centrally disposed support member for a box spring frame that includes an elongate slat, a generally L-shaped reinforcing member and means integral with the reinforcing member for affixing the reinforcing member to the slat to provide increased strength and reinforcement to the box spring frame.

BACKGROUND OF THE INVENTION

Currently, bed structures traditionally include a mattress and a box spring assembly. Box spring assemblies are typically constructed of a rectangular wooden frame having end rails, side rails and slats or rails attached to the end and side rails that support vertically extending springs or coils. Examples of such box spring frames are illustrated in U.S. Pat. Nos. 3,717,889, 3,877,091, 3,938,204, 3,958,284, and 3,971,081.

A problem with current box spring frames is that, in order to minimize costs, they are frequently constructed of the most readily available, and inexpensive material, such as green lumber or lumber having knots therein. Both of these conditions tend to lessen the strength of and shorten the useful life of such box spring frames.

Suggestions have been made in the prior art to reinforce and strengthen the support members of a box spring frame, e.g., U.S. Pat. No. 3,717,886. While this patent discloses an improvement over unreinforced box spring frame constructions, it requires an extraneous fastening means to secure the reinforcing members to the structural members. Moreover, the teachings of U.S. Pat. No. 3,717,886 are to reinforce the center rail and all of the slat members that extend at right angles with respect thereto. In each instance the reinforcing member is U-shaped in cross-section, and includes a bight portion that extends completely across the bottom surface of the member that it reinforces. In addition to being difficult and expensive to assemble, such an arrangement results in an excessive, and unnecessary, use of relatively expensive reinforcing material. And, box spring frames constructed in accordance with U.S. Pat. No. 3,717,886 are uncomfortably rigid, and in effect, have the characteristics of an all metal construction.

It can thus be seen that there is a substantial need for a box spring frame that is lightweight, yet which provides increased strength and support, and that can be readily manufactured.

SUMMARY OF THE INVENTION

The present invention contemplates an improved center support member for a box spring frame comprising an elongate slat, a generally L-shaped reinforcing member and means formed integrally with the reinforcing member for affixing the reinforcing member to the slat.

In one aspect of the present invention, the support member of the invention comprises an elongate slat, having a generally rectangular cross-sectional shape, and defined by generally parallel top and bottom surfaces and generally parallel side surfaces disposed generally perpendicularly with respect to the top and bottom surfaces. The elongate slat has affixed thereto a generally L-shaped reinforcing member, with penetrating means formed integrally with the reinforcing member and extending into the slat to unite the reinforcing member and slat without the need for an extraneous fastening means.

In another aspect of the present invention, the above-mentioned L-shaped reinforcing member includes a first leg positioned in surface-to-surface contact with a side surface of the elongate slat and a second leg generally perpendicular to the first leg and positioned in surface-to-surface contact with the bottom surface of the slat. Additionally, in at least one leg of the reinforcing member, a plurality of longitudinally spaced openings are present, having projecting outwardly therefrom means formed integrally with the reinforcing member to penetrate into the slat for affixing the reinforcing member into the slat.

The present invention provides several benefits and advantages.

One benefit of the present invention is that the support member of the invention is lightweight yet exemplified by increased strength and support capabilities.

Another benefit of the present invention is that the support member of the invention is relatively simple and inexpensive to manufacture as compared to heretofore known supports for box spring frames.

One of the advantages of the present invention is that the reinforcing members are affixed to the elongate slat without the use of staples, nails or other sharp connecting devices thereby minimizing risk of injury from sharp objects to the users of the support member and also minimizing breakage of the slat during the manufacturing of the support member.

Another advantage of the present invention is that the support member of the invention provides sufficient strength and is sufficiently reinforced to readily compensate for any weakness in the wooden slat should green lumber or lumber containing knots be used therefor.

Other benefits and advantages of the present invention will become readily apparent to those skilled in the art from the following detailed description of the invention, the drawings and the appended claims.

BRIEF DESCRIPTION OF THE DRAWINGS

In the drawings forming a portion of the disclosure of this invention:

FIG. 1 is a plan view of a box spring frame including the support member of the present invention.

FIG. 2 is an enlarged fragmentary perspective view of the topside of the box spring frame illustrating the support member of the present invention and the configuration of the reinforcing member on the elongate slat of the support member;

FIG. 3 is an enlarged fragmentary perspective view, with a portion of the elongate slat broken away, further illustrating the configuration of the reinforcing members on said slat;

FIG. 4 is an enlarged sectional view taken generally along line 4—4 of FIG. 3 illustrating the manner in which the reinforcing members are affixed to the elongate slat;

FIG. 5 is a fragmentary perspective view of the elongate slat of the present invention illustrating an alternative embodiment of the present invention in which one reinforcing member is affixed to said slat;

FIG. 6 is an enlarged sectional view taken generally along line 6—6 of FIG. 4 illustrating that the tangs of the penetrating means of the invention are arcuate in cross-section; and FIG. 7 is a schematic illustration of the initial step of the method for affixing the reinforcing members to the slat to form the support member of the invention.

FIG. 8 is a schematic illustration of the final step of the method for affixing the reinforcing members to the slat to form the support member of the invention.

FIG. 9 is a schematic illustration showing the reinforcing members affixed to the slat after the method steps illustrated in FIGS. 7 and 8.

DETAILED DESCRIPTION OF THE INVENTION

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

The present invention is directed to a support member for a box spring frame comprising an elongate slat and at least one generally L-shaped reinforcing member affixed to the slat.

With reference to FIGS. 1 and 2, a box spring frame including a preferred embodiment of the support member of the present invention is shown. Box spring frame 10 can be of any desired length and width. Frame 10 includes a pair of opposed side rails 12 and a pair of opposed end rails 14. Side rails 12 and end rails 14 are connected in a generally rectangular configuration and may be comprised of any suitable strong yet lightweight material such as wood.

Side rails 12 hve extending therebetween and connected thereto a plurality of transverse slat members 16. Slat members 16 are connected to the side rails 12 in spaced parallel relation to each other and are comprised of the same material as the side and end rails, which is preferably wood.

End rails 14 have extending longitudinally therebetween a center support member 18. Support member 18 additionally lies across the top face of the transverse slat members 16 in a plane perpendicular to the transverse slat members and is positioned in a location equidistant from each side rail 12.

Side rails 12, end rails 14, slat members 16 and center support member 18 are connected to each other as shown in FIGS. 1 and 2 by any suitable attachment means, such as nails, staples, glue or other adhesives well known in the art.

Support member 18 of the present invention includes an elongate slat 20 having a generally rectangular cross-sectional shape and which is defined by generally parallel top surface 22 and bottom surface 24 and generally parallel side surfaces 26 disposed generally perpendicularly, with respect to top surface 22 and bottom surface 24. Elongate slat 20 is preferably formed of wood.

Elongate slat 20 has affixed thereto one or more generally L-shaped reinforcing members 28. Reinforcing members 28 provide increased strength and reinforcement to the slat 20 and are preferably formed of metal, such as steel.

A preferred embodiment of the present invention is further shown in FIG. 3 wherein two reinforcing members 28 are affixed to the slat 20. Each generally L-shaped reinforcing member includes a first leg 30 positioned in surface-to-surface contact with a side surface 26 of the elongate slat 20 and a second leg 32 generally perpendicular to the first leg 30 and positioned in surface-to-surface contact with the bottom surface 24 of the slat 20.

The first legs 30 have a height dimension less than the height dimension of the side surfaces 26 whereby a portion of each side surface 26 is exposed above the first leg 30. The second legs 32 are spaced from one another whereby a portion of the bottom surface 24 is exposed between the second legs 32. Such an arrangement provides for adequate reinforcement, while minimizing the amount of reinforcing material, which is expensive compared to the price of the slat itself.

In at least one leg of each reinforcing member 28, a plurality of longitudinally spaced openings 34 are provided. Affixation means 36 are additionally formed integrally with each reinforcing member 28 projecting outwardly from at least one leg of the reinforcing member 28 at each of the openings 34. Affixation means 36 include penetrating means 38 that penetrate into the slat 20 for affixing each of the reinforcing members 28 to the slat 20.

The openings 34 are generally rectangularly shaped and are equally spaced from one another. At each end of each opening 34, penetrating means 38 is provided for penetrating into the slat 20 in order to affix a reinforcing member 28 thereto. The penetrating means 38 at each opening 34 are formed from material formerly occupying the opening and extends generally perpendicularly with respect to the at least one leg of the reinforcing member 28.

The plurality of longitudinally spaced openings 34 can be provided in the first leg 30 of each reinforcing membeer 28. In such a configuration, the penetrating means 38 extend outwardly from each end of each opening 34 generally perpendicularly with respect to the first leg 30. Preferably, each penetrating means 38 is a tang 40 having a base 42 in the plane of the first leg 30 that is the width of its respective opening 34, and a sharp point 44 at the end of the tang opposite the base 42. Each tang 40 is generally arcuate in cross-section as shown in FIG. 6.

In a preferred embodiment of the present invention, a plurality of longitudinally spaced projections 50 are also formed integrally with the second leg 32 of each reinforcing member 28 and extend into the slat 20 through the bottom surface 24 thereof. The projections 50 are struck from leg 32 after the reinforcing member has been affixed, and projections 50 are spaced by a distance corresponding to the distance between the projections 38 on the first leg 30.

The affixation of the reinforcing members 28 to the slat 20 to form the support member 18 of the invention can be accomplished by various operations. Exemplary of these is a single rolling and stamping operation, using an air cylinder, in which the tangs 40 are struck out in the reinforcing member 28 while the reinforcing members are simultaneously engaged with the surfaces 2, 24 and 26 of the slat 20 that is rigidly held in a jig assembly. This operation drives the tangs 40 into the side surfaces 26 of the slat 20, and thereafter the projections 50 in the second leg 32 of each reinforcing member 28 are driven into the slat 20. This operation securely affixes the reinforcing members 28 to the slat 20 to form the support member 18 of the present invention. The resulting affixation is illustrated in FIGS. 4 and 9 and the exemplary method of affixation is shown in FIGS. 7 and 8.

An alternative embodiment of the present invention is shown in FIG. 5. Elongate slat 120 has affixed thereto by penetrating means 138 a single reinforcing member 128 that provides increased strength and support to the slat 120 and thus forms a support member of the invention.

In each embodiment of the invention, flexural rigidity of the box spring frame is increased where it is most needed, i.e., in the center. The reinforcing members are secured in place without the use of extraneous fasteners, and a solid exposed wood upper surface of the support member is left for convenient mounting of the box springs, as by stapling.

The foregoing is intended as illustrative of the present invention but not limiting. Numerous variations and modifications may be effected without departing from the true spirit and scope of the invention.

What is claimed is:

1. A support member for a box spring frame comprising:

an elongate slat having a generally rectangular cross-sectional shape, and defined by generally parallel top and bottom surfaces and generally parallel side surfaces disposed generally perpendicularly with respect to said top and bottom surfaces;

a generally L-shaped reinforcing member including a first leg positioned in surface-to-surface contact with a side surface of said elongate slat and a second leg generally perpendicular to said first leg and positioned in surface-to-surface contact with the bottom surface of said slat;

a plurality of longitudinally spaced openings in at least one leg of said reinforcing member; and means formed integrally with said reinforcing member projecting outwardly from said at least one leg thereof at each of said openings and penetrating into said slat for affixing said reinforcing member to said slat.

2. A support member as set forth in claim 1 in which said openings are generally rectangularly shaped, and wherein a penetrating means is provided at the end of each opening.

3. A support member as set forth in claim 2 in which the penetrating means at each opening is formed from material formerly occupying the opening.

4. A support member as set forth in claim 3 in which the penetrating means extend generally perpendicularly with respect to said at least one leg.

5. A support member as set forth in claim 1 in which said slat is formed of wood and wherein said reinforcing member is formed of metal.

6. A support member for a box spring frame comprising:

an elongate wood slat having a generally rectangular cross-sectional shape, and defined by generally parallel top and bottom surfaces and generally parallel side surfaces disposed generally perpendicularly with respect to said top and bottom surfaces;

first and second generally L-shaped metal reinforcing members, each reinforcing member including a first leg positioned in surface-to-surface contact with a side surface of said elongate slat and a second leg generally perpendicular to said first leg and positioned in surface-to-surface contact with the bottom surface of said slat; and means formed integrally with each reinforcing member projecting outwardly from at least one leg thereof and penetrating into said slat for affixing said reinforcing member to said slat.

7. A support member as set forth in claim 6 in which a plurality of longitudinally spaced openings are provided in the first leg of each reinforcing member, and wherein said penetrating means extend outwardly from each end of each opening generally perpendicularly with respect to said first leg.

8. A support member as set forth in claim 7 wherein said openings are generally rectangularly shaped and equally spaced from one another.

9. A support member as set forth in claim 7 in which the penetrating means at each opening is formed from material formerly occupying the opening.

10. A support member as set forth in claim 9 wherein each penetrating means is a tang having a base in the plane of said first leg that is the width of its respective opening, and a sharp point at the end opposite said base.

11. A support member as set forth in claim 10 wherein said tangs are generally arcuate in cross-section.

12. A support member for a box spring frame comprising:

an elongate slat having a generally rectangular cross-sectional shape, and defined by generally parallel top and bottom surfaces and generally parallel side surfaces disposed generally perpendicularly with respect to said top and bottom surfaces; first and second generally L-shaped reinforcing members, each reinforcing member including a first leg positioned in surface-to-surface contact with a side surface of said elongate slat, said first legs having a height dimension less than the height dimension of said side surfaces whereby a portion of each side surface is exposed above said first leg, each reinforcing member including a second leg generally perpendicular to said first leg and positioned in surface-to-surface contact with the bottom surface of said slat, said second legs being spaced from one another, whereby a portion of said bottom surface is exposed between said second legs; and means formed integrally with each reinforcing member projecting outwardly from at least one leg thereof and penetrating into said slat for affixing said reinforcing members to said slats.

13. A support member as set forth in claim 12 wherein said penetrating means is defined by a plurality of projections extending outwardly from the first leg of each reinforcing member.

14. A support member as set forth in claim 12 wherein each projection is a tang having a sharpened end portion.

15. A support member as set forth in claim 14 wherein a plurality of longitudinally spaced projections are formed integrally with the second leg of each reinforcing member and extend into the slat through the bottom surface thereof.

16. A support member as set forth in claim 15, wherein the projections on said second leg are spaced by a distance corresponding to the distance between the projections on said first leg.

* * * * *